US012402739B2

(12) United States Patent
Deschenes et al.

(10) Patent No.: US 12,402,739 B2
(45) Date of Patent: Sep. 2, 2025

(54) FAST-FITTING DECORATIVE ASSEMBLY WITH FINIAL

(71) Applicant: KENNEY MANUFACTURING COMPANY, Warwick, RI (US)

(72) Inventors: Kate Deschenes, Warwick, RI (US); Timothy Elliott, Warwick, RI (US); Scott Violette, Richmond, RI (US)

(73) Assignee: KENNEY MANUFACTURING COMPANY

( * ) Notice: Subject to any disclaimer, the term of this patent is extended or adjusted under 35 U.S.C. 154(b) by 0 days.

(21) Appl. No.: 18/464,194

(22) Filed: Sep. 8, 2023

(65) Prior Publication Data

US 2024/0081572 A1 Mar. 14, 2024

Related U.S. Application Data

(60) Provisional application No. 63/375,138, filed on Sep. 9, 2022.

(51) Int. Cl.

| | |
|---|---|
| ***A47H 1/02*** | (2006.01) |
| ***A47H 1/102*** | (2006.01) |
| *A47H 23/00* | (2006.01) |

(52) U.S. Cl.

CPC ..... *A47H 1/02* (2013.01); *A47H 1/102* (2013.01); *A47H 2023/003* (2013.01)

(58) Field of Classification Search

CPC ..... A47H 1/02; A47H 1/022; A47H 1/142; A47H 1/102; A47H 2023/003; A47H 2001/0215

See application file for complete search history.

(56) References Cited

U.S. PATENT DOCUMENTS

| | | | | | |
|---|---|---|---|---|---|
| 1,529,740 | A * | 3/1925 | Henry | A47H 1/102 | 211/105.2 |
| 1,633,436 | A * | 6/1927 | Clifton | A47H 1/102 | 248/273 |
| 1,739,551 | A * | 12/1929 | Kasbarian | A47H 19/00 | 248/263 |
| 3,480,243 | A * | 11/1969 | Summerville, Jr. | A47H 1/102 | 248/225.11 |
| 4,226,395 | A * | 10/1980 | Bellinger | A47H 1/102 | 248/909 |
| 4,283,034 | A * | 8/1981 | Sheehan | A47H 1/102 | 248/909 |

(Continued)

FOREIGN PATENT DOCUMENTS

| | | | | |
|---|---|---|---|---|
| DE | 382224 C | * | 9/1923 | |
| DE | 29702108 U1 | * | 4/1997 | A47H 1/10 |

(Continued)

*Primary Examiner* — Stanton L Krycinski
(74) *Attorney, Agent, or Firm* — Adler Pollock & Sheehan P.C.

(57) ABSTRACT

A decorative assembly having a finial element and a fastening element configured to couple with the finial element, where the fastening element may be mounted to a surface such as a wall. The finial element may come in various shapes and sizes, including without limitation ball shape, end cap, cut acrylic, tiered glass, to name a few. The decorative assembly may be utilized for decorative purposes accenting the end of objects such as drapery or curtain rods.

3 Claims, 19 Drawing Sheets

(56) References Cited

U.S. PATENT DOCUMENTS 4,305,562 A * 12/1981 Bellinger ..... A47H 1/102 248/263
4,662,593 A * 5/1987 Shames ..... F16M 13/02 248/251
4,979,713 A * 12/1990 Bell ..... A47K 10/10 248/221.11
5,024,338 A * 6/1991 Austin ..... A47H 1/142 211/105.1
5,975,184 A * 11/1999 Nien ..... E06B 9/36 160/902
6,019,233 A * 2/2000 Yu ..... A47K 3/38 211/87.01
6,206,074 B1 * 3/2001 Liu ..... A47H 99/00 160/349.2
6,371,423 B1 * 4/2002 Miller ..... A47H 1/102 248/221.12
8,231,093 B2 * 7/2012 Tran ..... A47H 1/142 248/262
8,430,369 B2 * 4/2013 Hsu ..... A47K 10/04 248/221.11
8,671,545 B1 * 3/2014 Zimmerman ..... A47G 25/0635 211/16
9,839,332 B2 * 12/2017 Austin, III ..... A47K 10/04
11,006,786 B1 * 5/2021 Daniels ..... A47K 10/10
11,274,790 B2 * 3/2022 Maclaren-Taylor .... F16B 2/065
11,627,824 B2 * 4/2023 DiTrolio ..... A47H 1/102 403/361
11,812,883 B2 * 11/2023 Hanley ..... A47H 1/122
12,193,588 B1 * 1/2025 Hanley ..... A47H 1/102
2005/0028945 A1 * 2/2005 Hsu ..... E06B 9/323 160/178.1 R
2009/0108157 A1 * 4/2009 Spencer ..... A47G 25/0635 248/222.13
2012/0067837 A1 * 3/2012 He ..... A47K 10/10 211/1
2012/0123896 A1 * 5/2012 Prodanovic ..... A47K 10/10 705/26.5
2012/0228446 A1 * 9/2012 Mikovich ..... A47H 1/102 248/220.22
2014/0306079 A1 * 10/2014 Kuo ..... F16B 9/05 248/222.14
2017/0336020 A1 * 11/2017 Jones ..... A47K 10/10

FOREIGN PATENT DOCUMENTS

EP 1095603 A2 * 5/2001 ..... A47H 27/00
FR 357585 A * 1/1906
FR 544607 A * 9/1922
FR 700466 A * 3/1931
GB 190903392 A * 12/1909
GB 285600 A * 2/1928

* cited by examiner

300

400

FAST-FITTING DECORATIVE ASSEMBLY WITH FINIAL

CROSS-REFERENCE TO RELATED APPLICATIONS

This application claims benefit from U.S. Provisional Patent Application Ser. No. 63/375,138, filed Sep. 9, 2022, which is incorporated by reference in its entirety.

FIELD OF THE INVENTION

The present invention generally relates to decorative assemblies and specifically, to finial assemblies that accent the top or end of an object in order to provide darkening and/or privacy in a room in which the object is mounted.

BACKGROUND

Finials may be utilized as decorative ends of drapery or curtain rods and may also be utilized for non-decorative functions, such as keeping drapery or curtains from sliding off the end of a rod. Finials are decorative end pieces that may fit at ends of a drapery rod to give it a finished, ornamental look. Finials may be provided in many styles and finishes to coordinate with the style of a room in which they are utilized. For example, the finials may be made of metal or wood and may be screwed into the ends of the drapery or curtain rods.

When considering the use of drapery or curtain rods that are intended to provide for darkening or privacy of a room, there is a challenge when it is desired to be able to attach and detach the rod for easy and efficient movement of the rod when the darkening or privacy of a room is desired on a non-permanent basis but still provide an ornamental look. When drapery or curtain rods are mounted directly to a wall, installation and subsequent attachment and detachment of the rod is complicated and inefficient, thereby not facilitating utilization of the rod and corresponding finials as intended and making the use of finials undesirable for either decorative or non-decorative functions. The present invention provides a drapery or curtain rod that incorporates a finial that is both uncomplicated and efficient and such that the rod with one or more finials may be attached and detached for easy and efficient movement.

SUMMARY OF THE INVENTION

The following presents a summary of the invention in order to provide a basic understanding of some aspects of the invention. This summary is not an extensive overview of the invention. It is intended to neither identify key or critical elements of the invention nor delineate the scope of the invention. The purpose of this summary is to present some concepts of the invention in a simplified form as a prelude to the more detailed description that is presented subsequently.

Disclosed is a decorative assembly according to embodiments of the present invention. The decorative assembly may be utilized to provide darkening and/or privacy of a room and also is also easily attached and detached for easy and efficient movement of the decorative assembly.

In one embodiment, the decorative assembly includes a finial element and a fastening element configured to couple with the finial element. The fastening element may be mounted to a surface, such as a wall or inside a window such that a curtain or drapery mounted on the rod on which the finial element is mounted hangs over the window to provide darkening and/or privacy. The finial element may embody various shapes and sizes. The finial element may have a shape, such as a ball shape or an end cap, and may be cut acrylic or tiered glass as well as other shapes. The decorative assembly may be utilized for decorative purposes by accenting the end of objects, such as drapery or curtain rods.

Some of the benefits of the present invention include ease of installation to provide darkening and/or privacy of a room without sacrificing the aesthetics of a traditional decorative rod set and to facilitate easy detachment and movement to other windows or rooms. In addition, the decorative assembly including the finial element and the fastening element may have lower material cost than traditional decorative rod sets and are easier to install since they are fast-fitting and require no brackets or drilling to install and uninstall. The present invention further provides an alternative to wrap-rods or tension rods used in a traditional decorative rod set.

These and other features and advantages will be apparent from the following detailed description, the associated drawings, and appended claims. It is to be understood that both the foregoing general description and the subsequent detailed description are only explanatory and are not restrictive of aspects of the invention as claimed.

BRIEF DESCRIPTION OF THE DRAWINGS

These and other features, aspects, and advantages of the present invention will be better understood with reference to the following description and appended claims in view of the drawings where:

FIG. 3(*b*) is a top-down view of the decorative assembly in FIG. 3(*a*).

FIG. 4(*b*) is a top view of the decorative assembly in FIG. 4(*a*).

FIG. 4(*c*) is a perspective detached view of the corner wall bracket of the decorative assembly in FIG. 4(*a*).

FIG. 4(*d*) is a perspective detached view of the corner wall bracket in FIG. 4(*c*).

FIG. 5(*b*) is a connected view of the fastening element in FIG. 5(*a*).

FIG. 5(*c*) is a perspective detached view of another embodiment of the fastening element in FIG. 5(*a*).

FIG. 6(*b*) is an assembled view of the wrap-rod in FIG. 6(*a*).

FIG. 9(*b*) is an assembled view of the finial assembly in FIG. 9(*a*).

FIG. 9(*c*) is a perspective detached view of another embodiment of the finial assembly in FIGS. 9(*a*) and 9(*b*).

FIG. 9(*d*) is an assembled view of the finial assembly in FIG. 9(*c*).

DETAILED DESCRIPTION OF THE INVENTION

Figure 1:
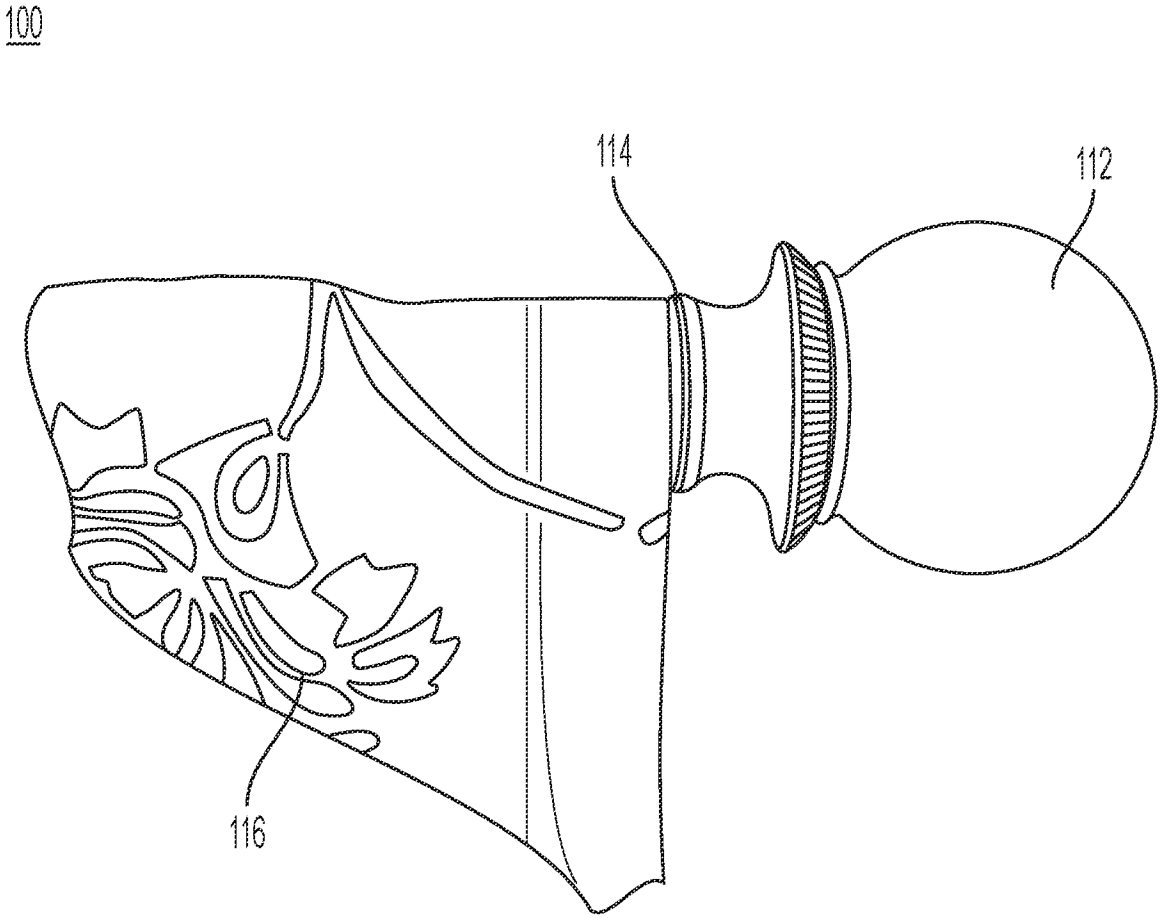
FIG. 1 is a front view of a decorative assembly according to an embodiment of the present invention.

The present invention is now described with reference to the drawings, wherein like reference numerals refer to like elements throughout. In the following description, for purposes of explanation, numerous specific details are set forth in order to provide a thorough understanding of the present invention. However, the present invention may be practiced without any or only some of these specific details. In the figures, well-known structures and devices may be shown in block diagram form in order to facilitate describing the present invention.

FIG. 1 is front view of a decorative assembly 100 according to an embodiment of the present invention. As shown in FIG. 1, the decorative assembly 100 includes a finial element 112 and a rod 114. Although the finial element 112 is shown in FIG. 1 with a round end cap, the finial element may be various shapes and sizes.

Figure 3A:
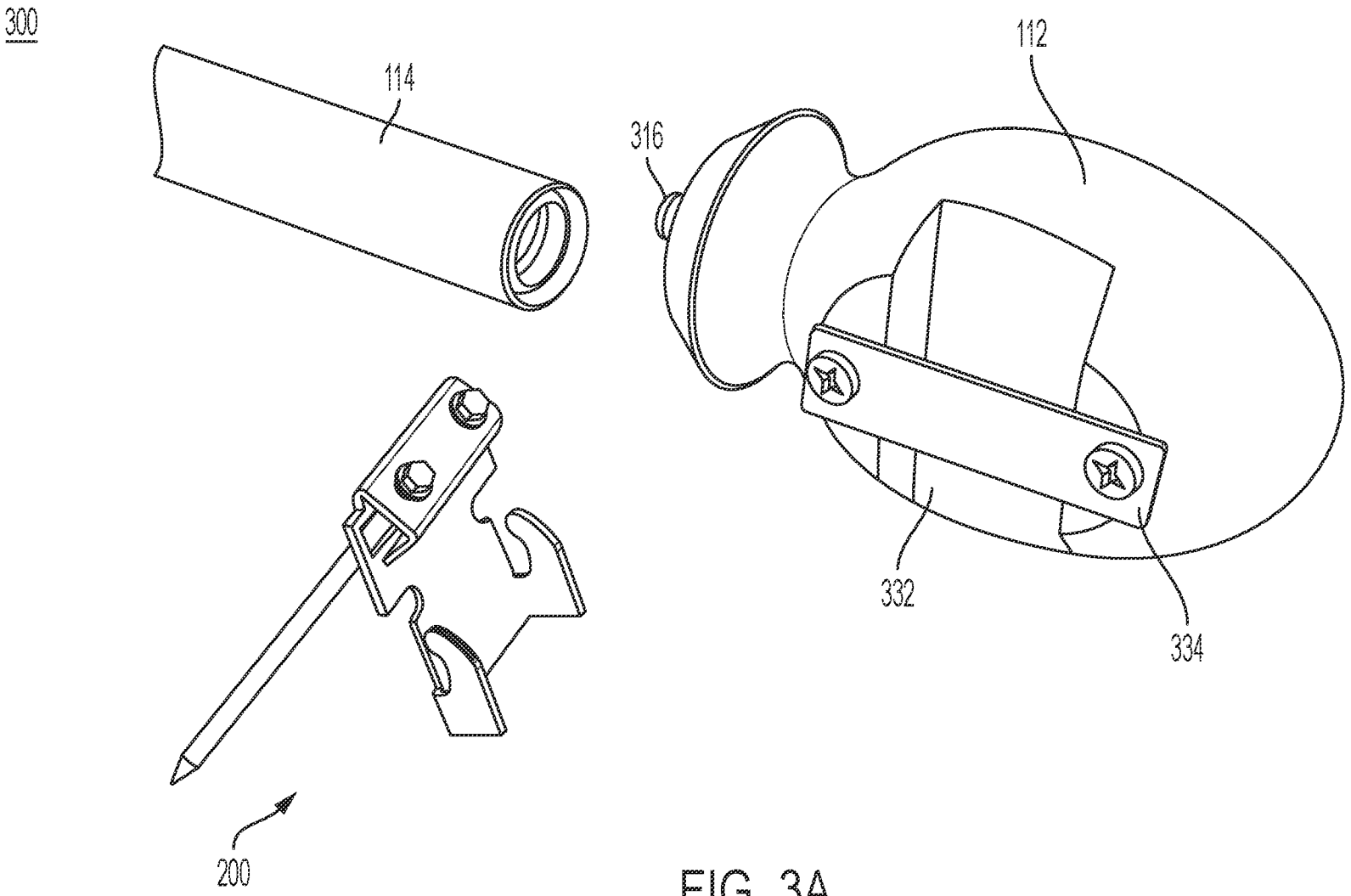
FIG. 3(*a*) is a perspective detached view of a decorative assembly according to an embodiment of the present invention.
Figure 3B:
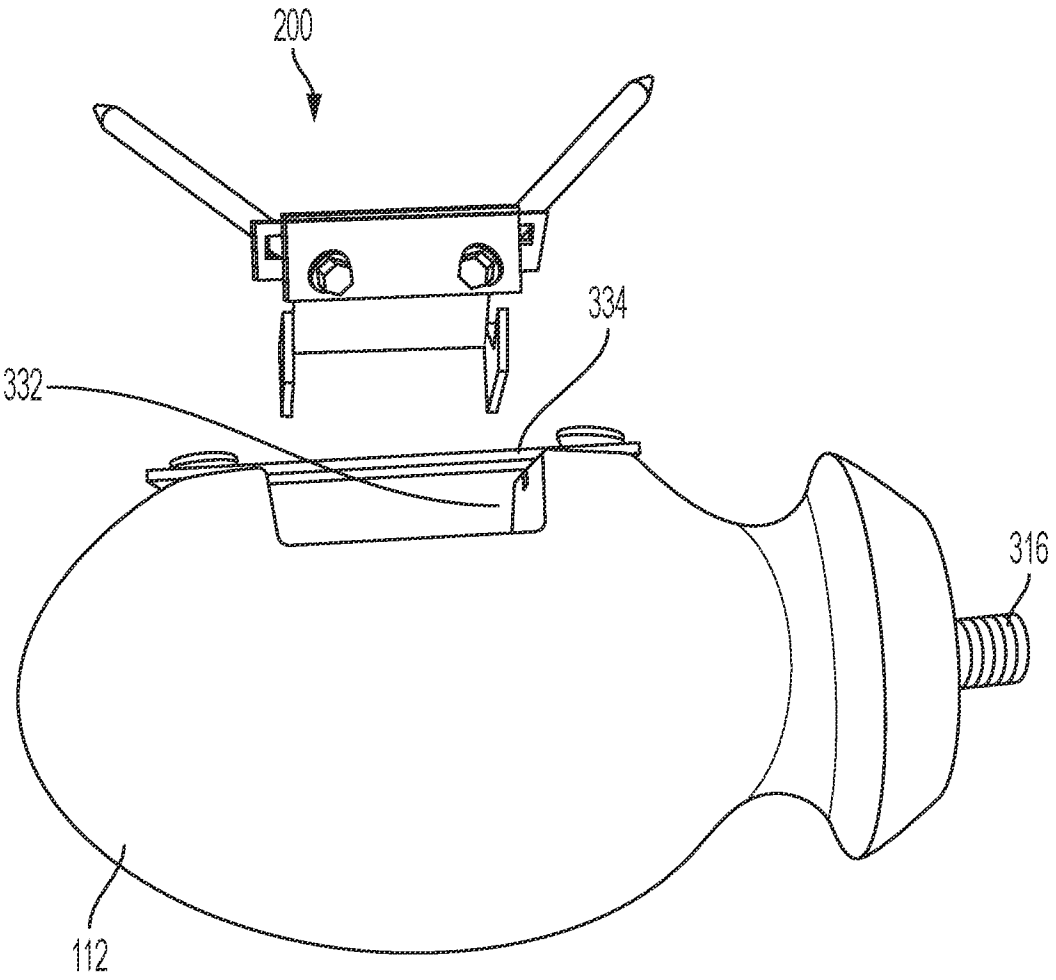
Figure 4A:
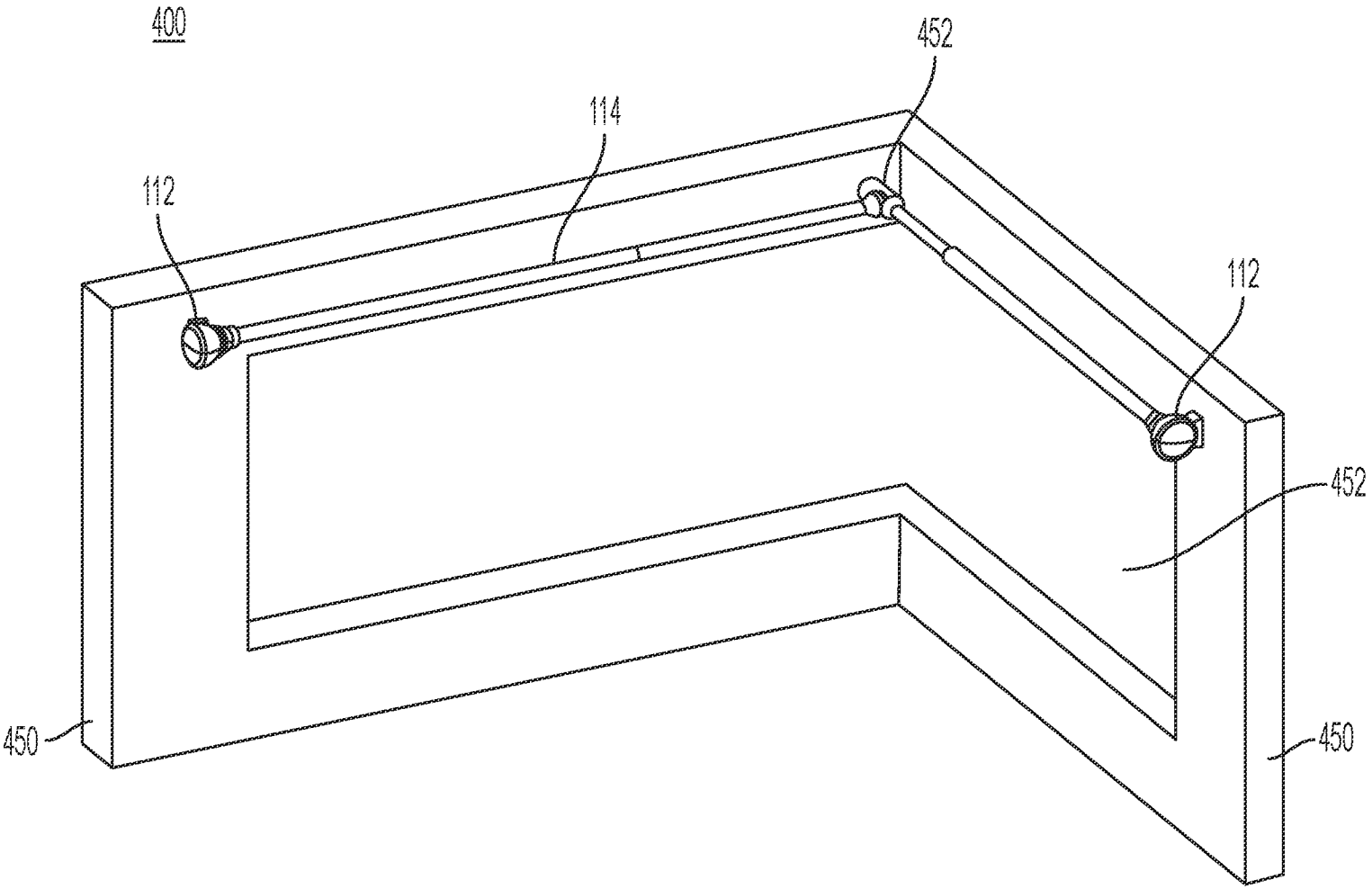
FIG. 4(*a*) is a perspective view of a decorative assembly according to an embodiment of the present invention that may be utilized for windows encompassing two perpendicular walls.
Figure 4B:
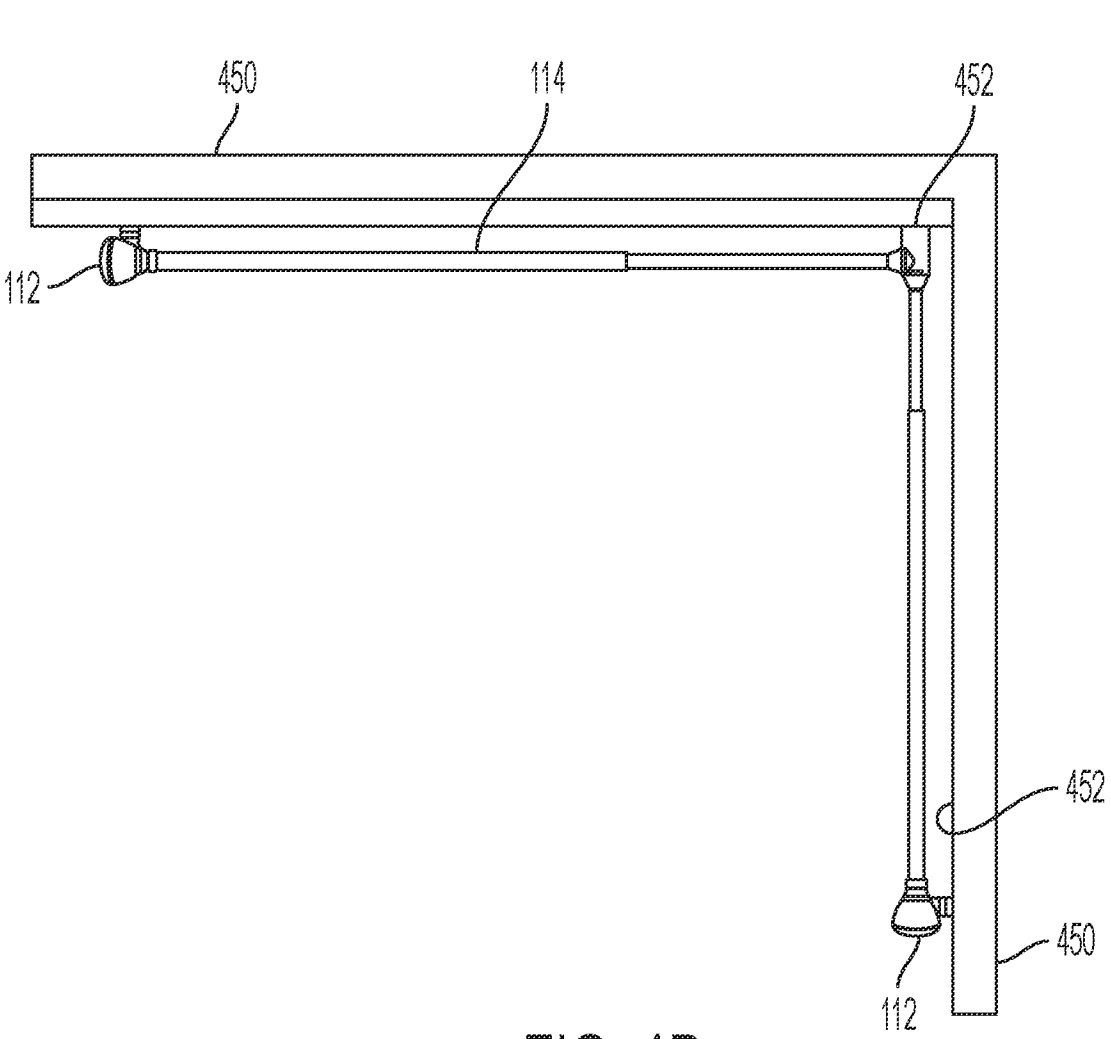
Figure 4C:
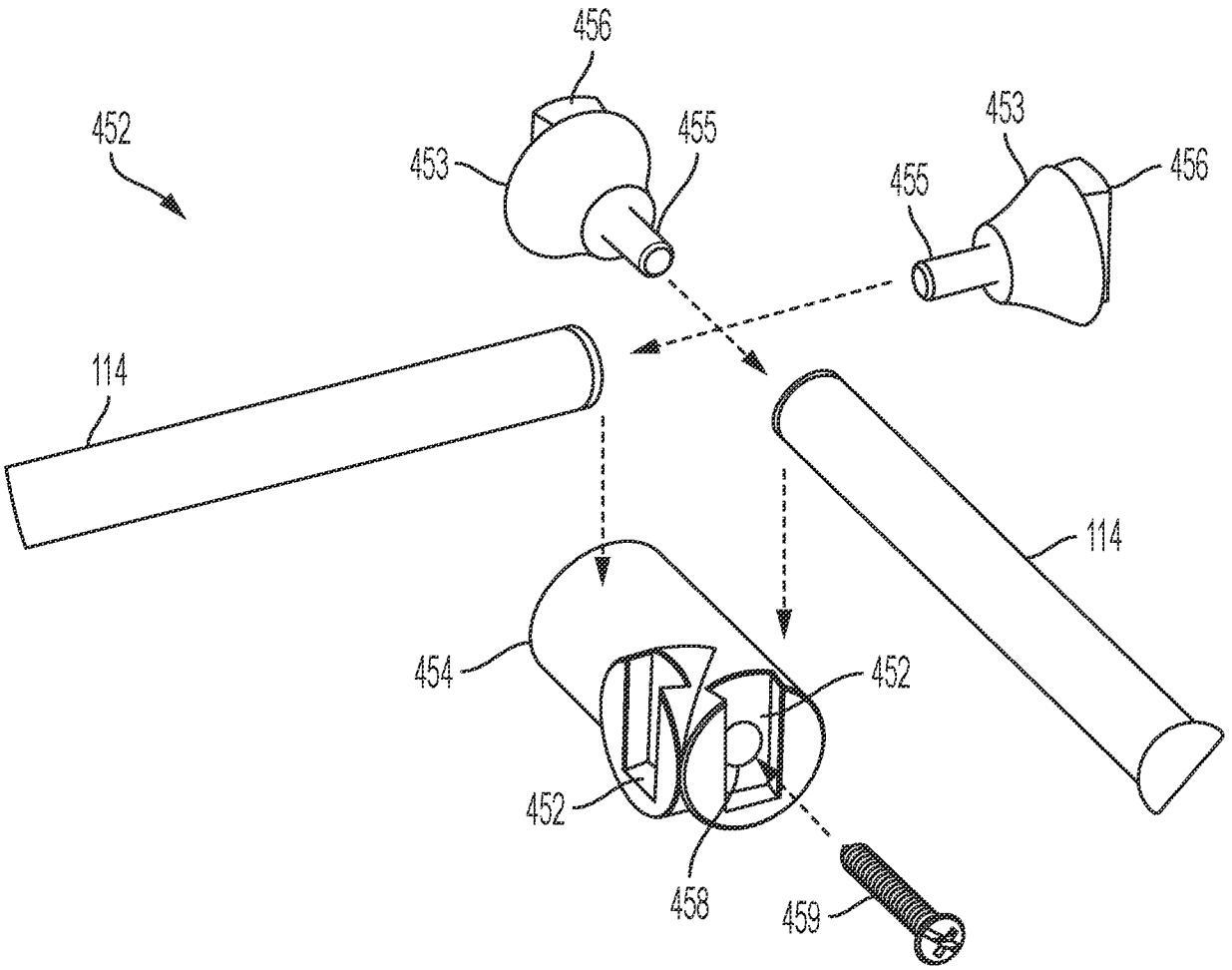
Figure 4D:
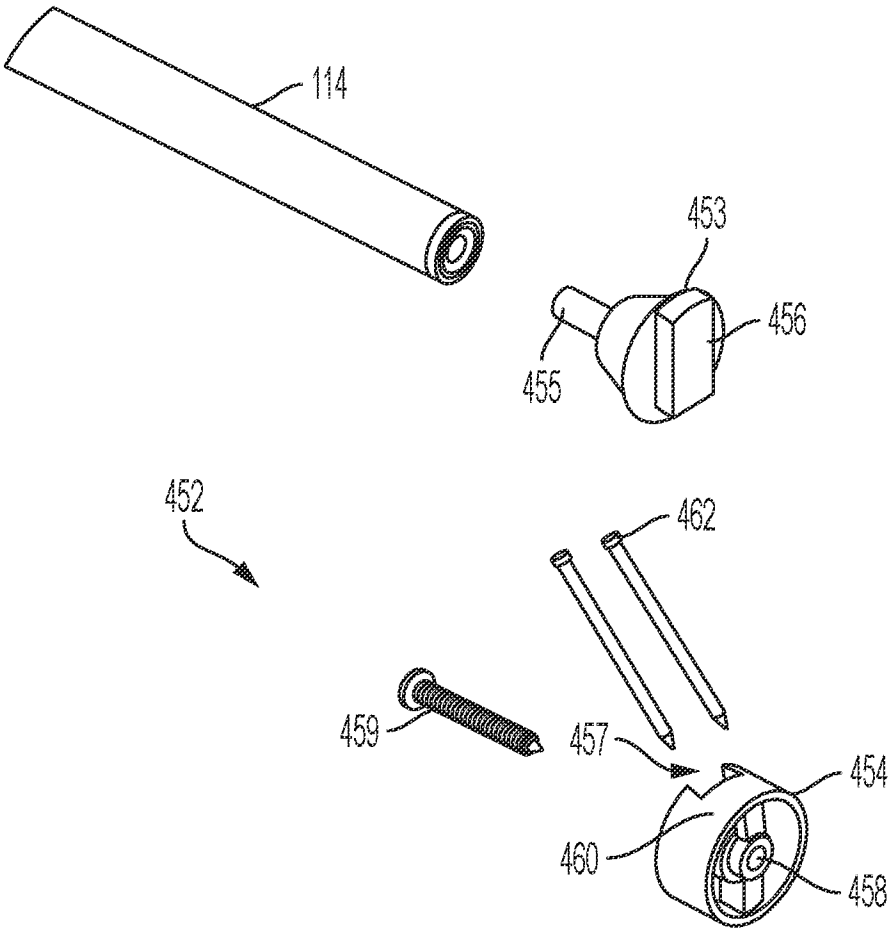

The finial element 112 may be secured to the rod 114 via a screw element (see FIGS. 3(*a*) and 3(*b*)). Alternatively, the finial element 112 may be secured to the rod 114 via other fasteners, such as glue.

Once secured, the finial element 112 and the rod 114 may be secured to a wall (See FIGS. 4(*a*) and 4(*b*)) via a fastening element (see FIG. 2) and suitable wall fasteners, such as nails, screws or wall plugs. Drapery or curtains 116 may be mounted to the rod 114 via apertures.

Figure 2:
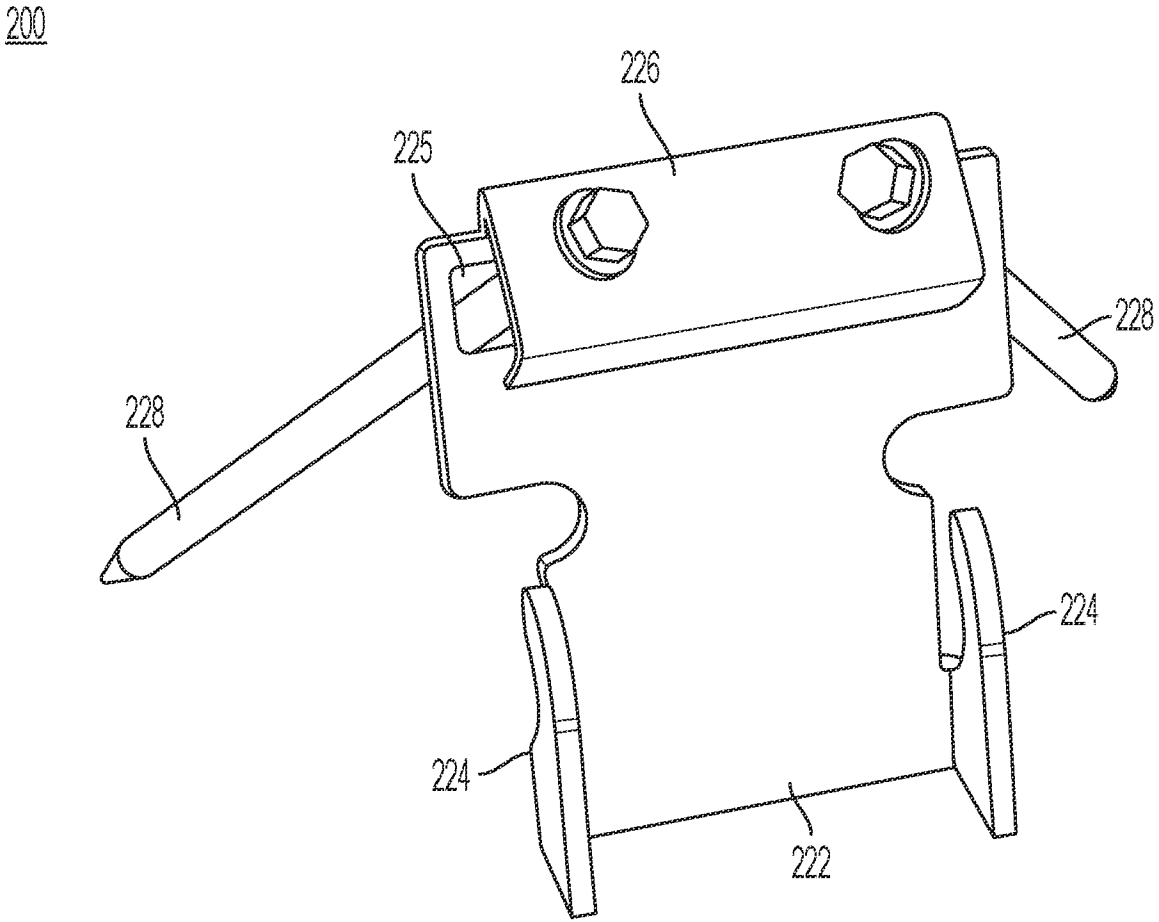
FIG. 2 is a perspective view of a fastening element for a decorative assembly according to an embodiment of the present invention.

FIG. 2 is a perspective view of a fastening element for a decorative assembly according to an embodiment of the present invention. As shown in FIG. 2, the fastening element 200 includes a body 222 with a pair of hook elements 224 at a lower portion of the body 222.

An upper portion of the body 222 includes an opening 225 to receive a plate 226 having a pair of nails 228 extending therefrom. The plate 226 and the nails 228 may be configured to fasten to a wall. For example, the nails 228 may be securely fastened to stud portions of a wall. While nails 228 are shown in FIG. 2, it will be understood that other fasteners, such as removable screws or plugs, may also be utilized.

Once mounted, such as when the nails 228 are securely embedded into a wall, the plate 226 may be securely flushed to the wall together with the body 222 of the fastening element 200. Since forces are exerted by the nails 228 and the plate 226, the body 222 will also be securely fastened to the wall, with the hook elements 224 extending upwardly and outwardly from the wall. The hook elements 224 may be utilized to receive a finial element 112, such as that disclosed with regard to FIG. 1.

FIG. 3(*a*) is a perspective view of a decorative assembly according to an embodiment of the present invention. FIG. 3(*b*) is a top-down view of the decorative assembly in FIG. 3(*a*).

As shown in FIGS. 3(*a*) and 3(*b*), the decorative assembly 300 includes a finial element 112, a rod 114 and a fastening element 200, such as that disclosed with regard to FIGS. 1 and 2.

The finial element 112 may be secured to the rod 114 via a screw element 316 as shown. For example, the finial element 112 may be screwed into the rod 114 by rotating the finial element 112 about the rod 114. Although a screw element 316 is shown, it will be understood that other fasteners, such as plugs or pins, may also be utilized.

While the end of the finial element 112 shown in FIGS. 3(*a*) and 3(*b*) has an oblong shape, it will be understood that the ends of the finial element 112 may be a variety of shapes and sizes. The finial element may have a shape, such as a ball shape or an end cap, and may be cut acrylic or tiered glass as well as other shapes. The decorative assembly 300 may be utilized for decorative purposes by accenting the end of objects, such as the rod 114 disclosed with regard to FIG. 1, with accompanying drapery or curtains.

In the embodiment shown in FIGS. 3(*a*) and 3(*b*), the finial element 112 includes a recess 332 and a plate 334. As disclosed with regard to FIG. 2, the fastening element 200 may be securely mounted to a wall with the hook elements 224 extending upwardly and outwardly.

In operation, the finial element 112 may be mounted to the wall fastening element 200, with the hook elements 224 engaging the plate 334 and being received within the recess 332. This allows the finial element 112 to be easily and quickly mounted on and removed from the wall fastening element 200. The combination of the finial element 112 and the fastening element 200 collectively forms the decorative assembly 300.

The fastening element 200 may be initially secured to a wall, as disclosed with regard to FIG. 2. There may be a plurality of wall fastening elements 200 mounted to the wall depending on the length and weight of the rod 114, as well as the weight of any drapery or curtains 116 (see FIG. 1) themselves (not shown).

FIG. 4(*a*) is a perspective view of a decorative assembly according to an embodiment of the present invention that may be utilized for windows encompassing two perpendicular walls. FIG. 4(*b*) is a top view of the decorative assembly in FIG. 4(*a*). FIG. 4(*c*) is a perspective detached view of the corner wall bracket of the decorative assembly in FIG. 4(*a*). FIG. 4(*d*) is a perspective detached view of an alternate corner wall bracket in FIG. 4(*c*).

As shown in FIGS. 4(*a*) and 4(*b*), when the decorative assembly 400 is installed in a corner window 452 that encompasses two perpendicular walls 450 with insufficient wall space for a finial element 112, such as that disclosed with regard to FIG. 1, at each end of the decorative assembly 400, the decorative assembly 430 includes two telescoping rods 114, such as that disclosed with regard to FIG. 1, each of the two telescoping rods 114 having a finial element 112, such as that disclosed with regard to FIG. 1, at one end as well as a corner wall bracket 452 at the other end with each corner wall bracket 452 attached to a wall 450 and via which the two telescoping rods 114 are attached to each other. Each finial element 112 is attached to a corresponding wall 450 utilizing a fastening element 200 (see FIG. 2). The wall corner bracket 452 facilitates installing the decorative assembly 430 in windows that do not have sufficient wall space at all sides.

As shown in FIG. 4(*c*), the corner wall bracket 452 includes two end brackets 453 and a corner fastening element 454. Each of the two end brackets 453 is inserted into the corner fastening element 454.

Each of the end brackets 453 includes an extending portion 455 and an extended end portion 456. Each of the rods 114, such as that disclosed with regard to FIG. 1, is mounted to one of the end brackets 453 by inserting the extending portion 455 into the rod 114.

The corner fastening element 454 includes two insertion portions 457 and at least one screw hole 458. Each of the end brackets 453 is attached to the fastening element 454 by inserting the corresponding extended end portion 456 into one of the insertion portions 457 of the fastening element 454. The fastening element 454 is attached to at least one of the walls 450 by inserting a screw 459 into at the least one screw hole 458. The fastening element 454 may be fastened to one or both of the perpendicular walls 450.

As shown in FIG. 4(*d*), an alternate embodiment of the corner wall bracket 452 may be utilized when the decorative assembly 400 is installed inside a window that is too close to a perpendicular wall to utilize the fastening element 200 shown in FIG. 2. As shown in FIG. 4(*d*), the corner wall bracket 452 includes an end bracket 453 and a wall fastening element 454, similar to that disclosed in FIG. 4(*c*).

The end bracket 453 includes an extending portion 455 and an extended end portion 456. The wall fastening element 454 includes an insertion portion 457 and a screw hole 458. The end bracket 453 is attached to the fastening element 454 by inserting the end portion 456 into the insertion portion 457. A rod, such as that disclosed with regard to FIG. 1, is mounted to the end bracket 453 by inserting the extended portion 455 into the rod.

The wall fastening element 454 is attached to a wall 450 (see FIGS. 4(*a*) and 4(*b*)) by inserting a screw 459 into the screw hole 458. Alternatively, the end bracket 454 may include nail holes 460 instead of, or in addition to, the screw hole 458, into which nails 462 are inserted in order to attach the wall fastening element 454 to a wall 450 (see FIGS. 4(*a*) and 4(*b*).

Figure 5A:
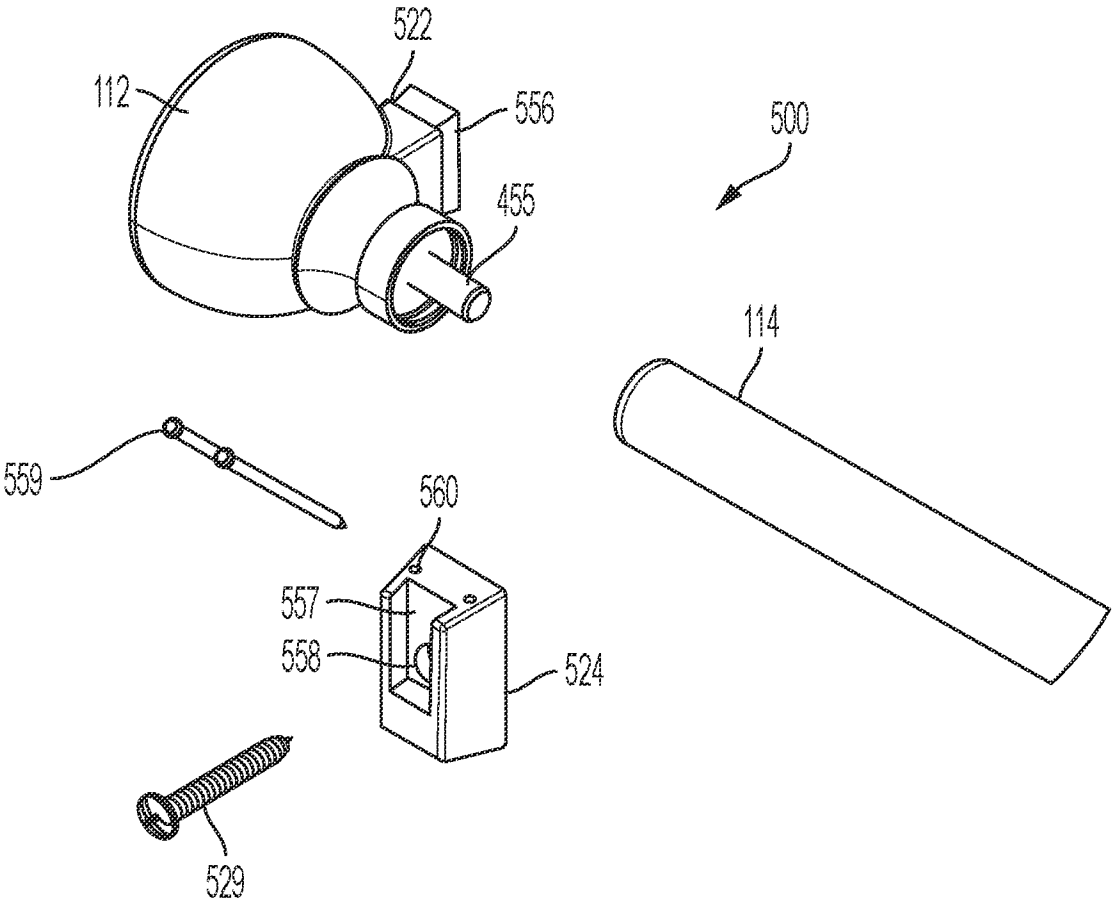
FIG. 5(*a*) is a perspective detached view of a fastening element of a decorative assembly according to an embodiment of the present invention.
Figure 5B:
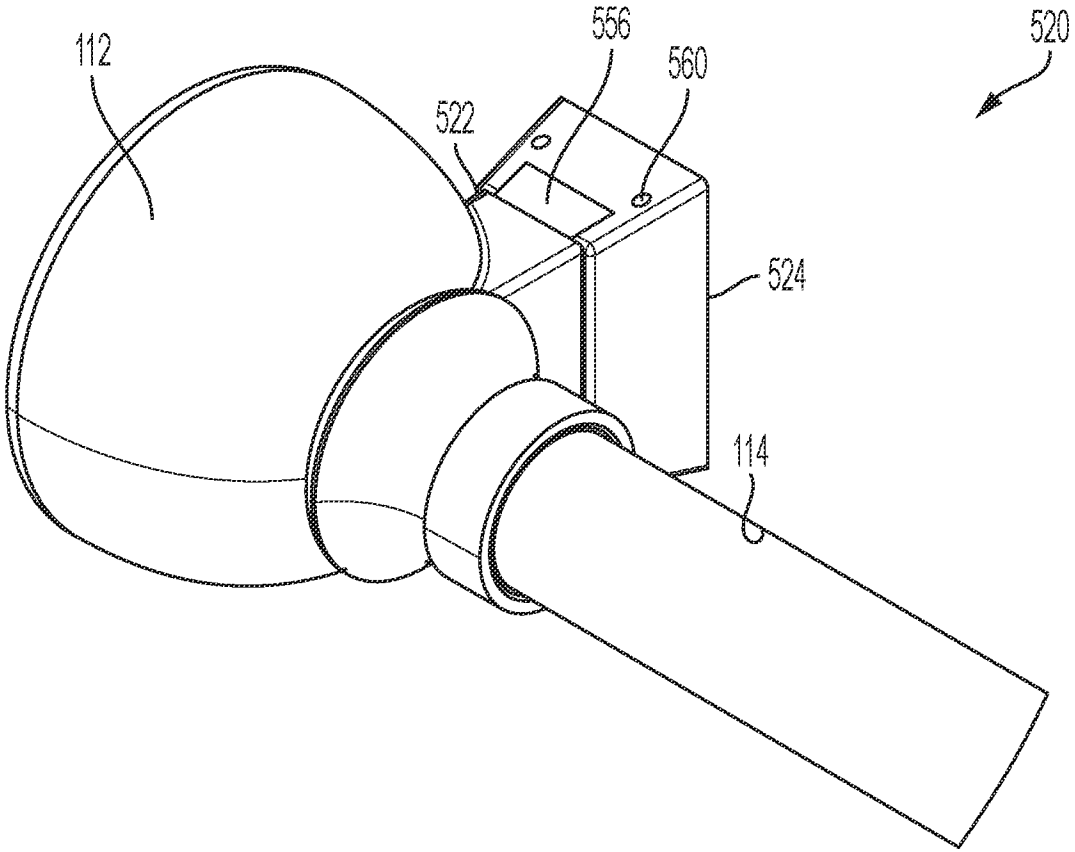
Figure 5C:
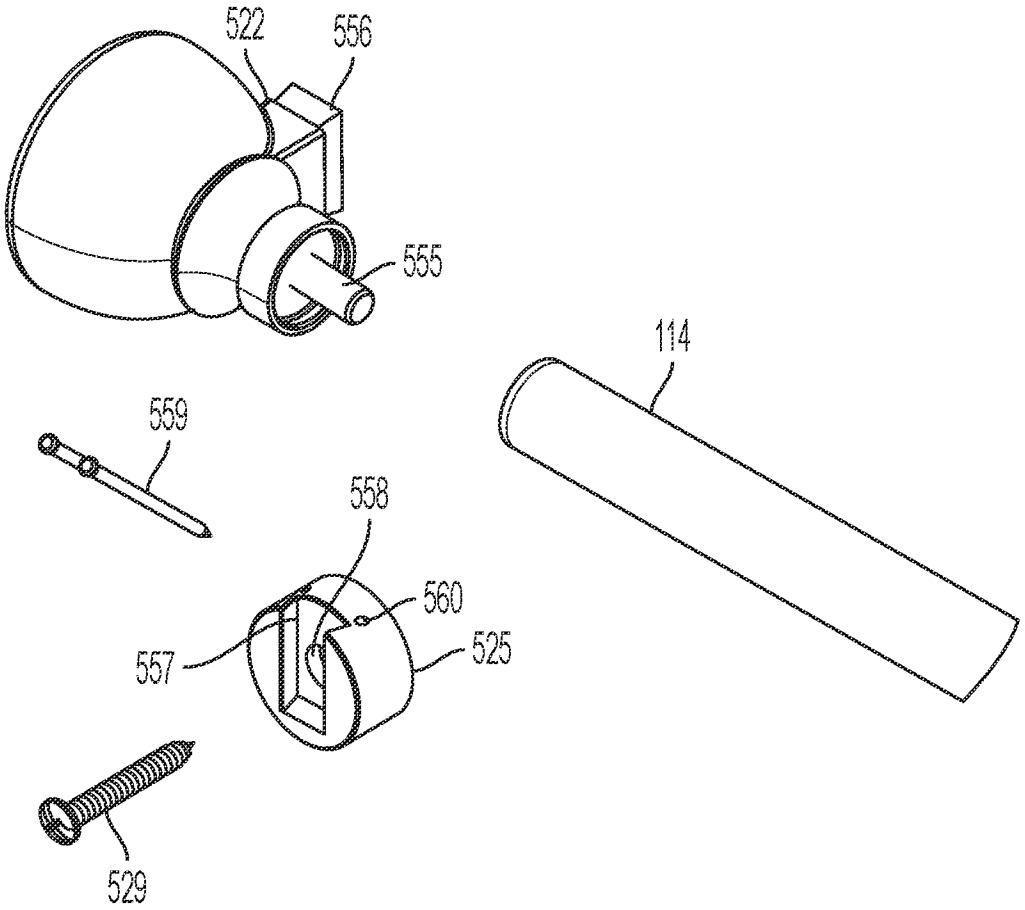

FIG. 5(*a*) is a perspective detached view of a fastening element of a decorative assembly according to an embodiment of the present invention. FIG. 5(*b*) is a connected view of the fastening element in FIG. 5(*a*). FIG. 5(*c*) is a perspective detached view of another embodiment of the fastening element in FIG. 5(*a*).

As shown in FIGS. 5(*a*) and 5(*b*), the fastening element 520 is utilized to attach a finial element 112 that is attached to a rod 114, such as that disclosed with regard to FIG. 1, to a wall 450 (see FIGS. 4(*a*) and 4(*b*)). The fastening element 520 includes a finial bracket 522 and a wall bracket 524. The finial element 112 includes an extending portion 555 that is utilized to attach the rod 114 to the finial element 112.

The finial bracket 522 includes an extended end portion 556, similar to that disclosed with regard to FIGS. 4(*c*) and 4(*d*), and is attached to the finial element 112. The wall bracket 524 includes an insertion portion 557 and a screw hole 558 and is attached to a wall 450 (see FIGS. 4(*a*) and 4(*b*)) by insertion of a screw 529 into the screw hole 558 or, alternately, by nails or pins 559 inserted into holes 560 in the wall bracket 524. The finial 112 with the rod 114 attached is then attached to the wall bracket 524 by inserting the extended end portion 556 of the finial bracket 522 into the insertion portion 557 of the wall bracket 524.

Although the wall bracket 524 shown in FIGS. 5(*a*) and 5(*b*) has a rectangular shape, it will be understood that the wall bracket 524 may be a variety of shapes and sizes, such as a square shape or round shape. As shown in FIG. 5(*c*), a wall bracket 525 is utilized in a similar manner as the wall bracket 524 disclosed with regard to FIGS. 5 (*a*) and 5(*b*) but has a circular shape.

Figure 6A:
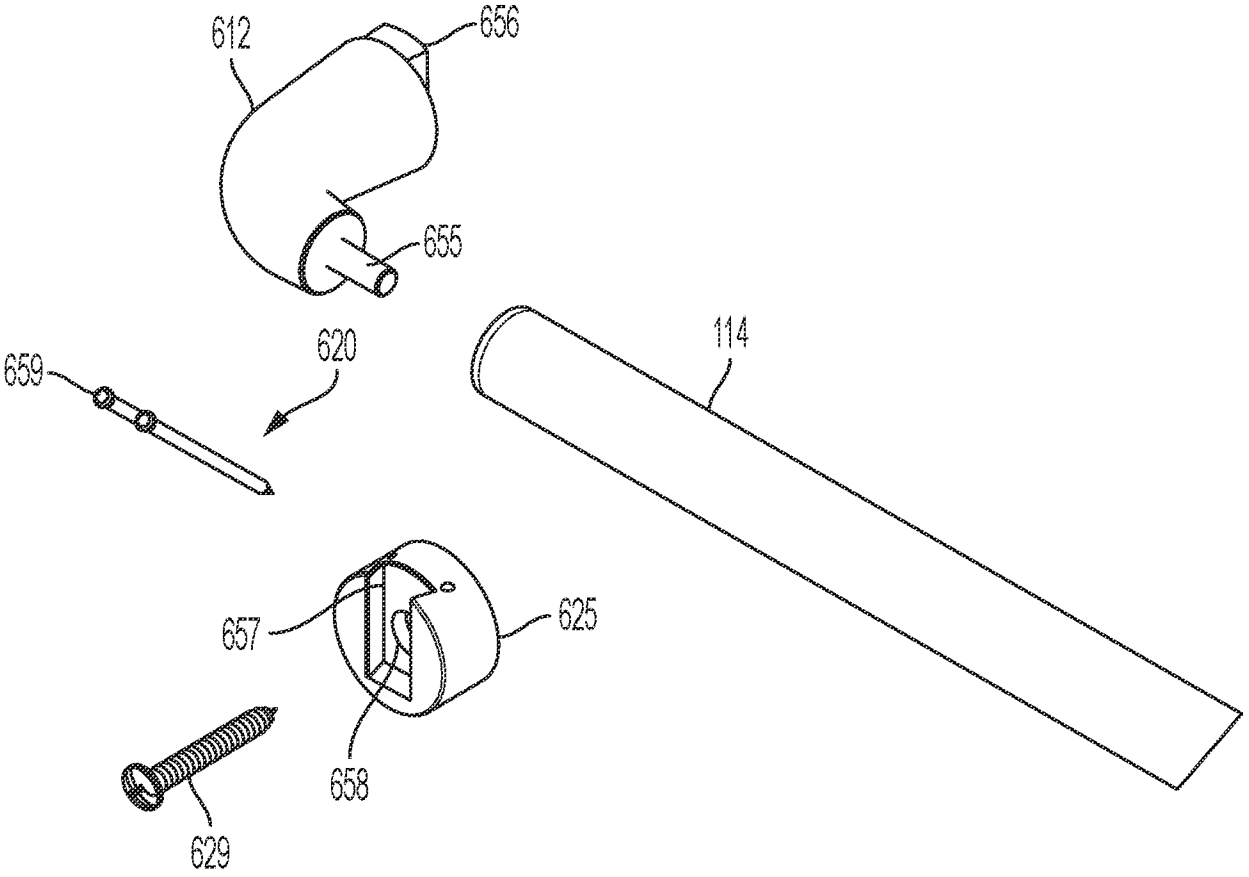
FIG. 6(*a*) is a perspective detached view of a wrap-rod utilizing the same base as a finial bracket according to an embodiment of the present invention.
Figure 6B:
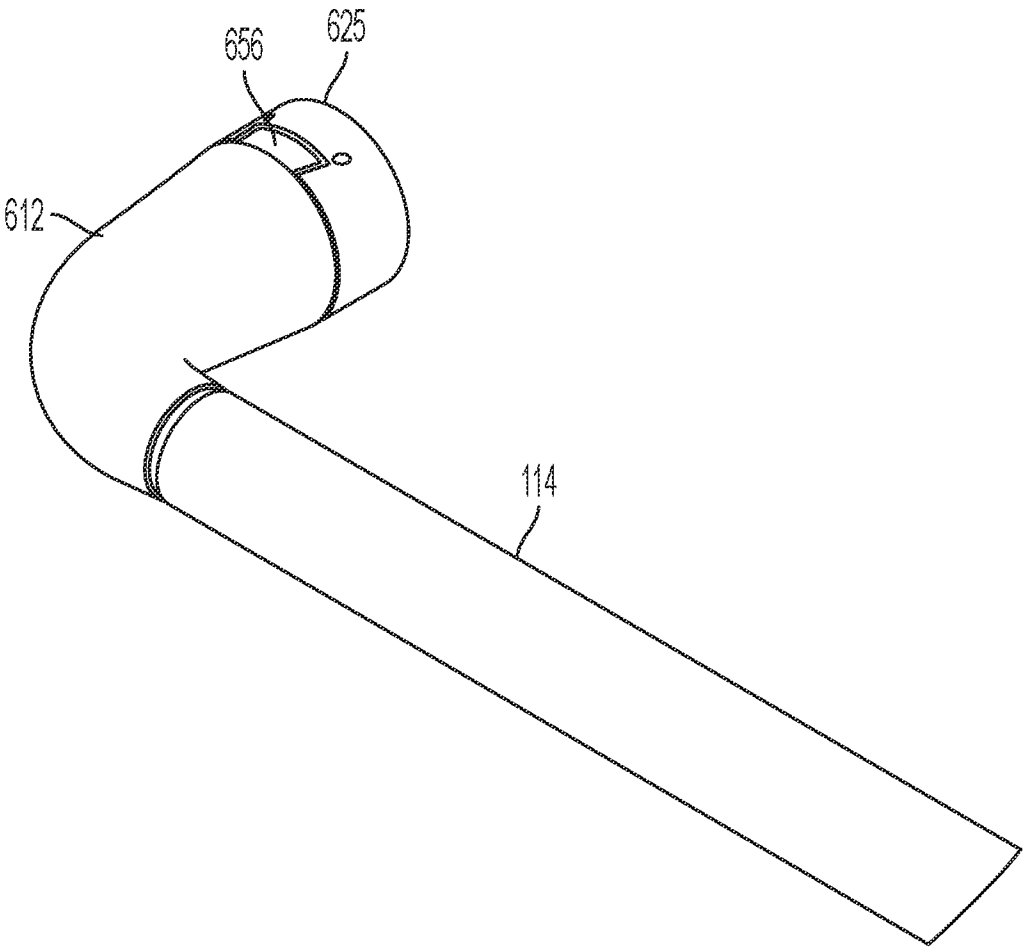

FIG. 6(*a*) is a perspective detached view of a wrap-rod utilizing the same base as a finial bracket according to an embodiment of the present invention. FIG. 6(*b*) is an assembled view of the wrap-rod in FIG. 6(*a*).

As shown in FIGS. 6(*a*) and 6(*b*), the wrap-rod 620 has the finial element 112 shown in FIGS. 5(*a*) and 5(*b*) replaced with a wrap-rod element 612. The wrap-rod element 612 is utilized to attach a rod 114, such as that disclosed with regard to FIG. 1, to a wall 450 (see FIGS. 4(*a*) and 4(*b*)). The wrap-rod 620 includes a wall bracket 625 and the wrap-rod element 612, which is attached to the wall bracket 625.

The wrap-rod element 612 further includes an extending portion 655, similar to that disclosed with regard to FIGS. 5(*a*) and 5(*b*), that is utilized to attach the rod 114 to the wrap-rod element 612. The wrap-rod element 612 includes an extended end portion 656, similar to that disclosed with regard to FIGS. 4(*c*) and 4(*d*). The wall bracket 625 includes an insertion portion 657 and a screw hole 658 and is attached to a wall 450 (see FIGS. 4(*a*) and 4(*b*)) by insertion of a screw 629 into the screw hole 658 or, alternatively, by nails or pins 659 inserted into holes 660 in the wall bracket 625.

Figure 7:
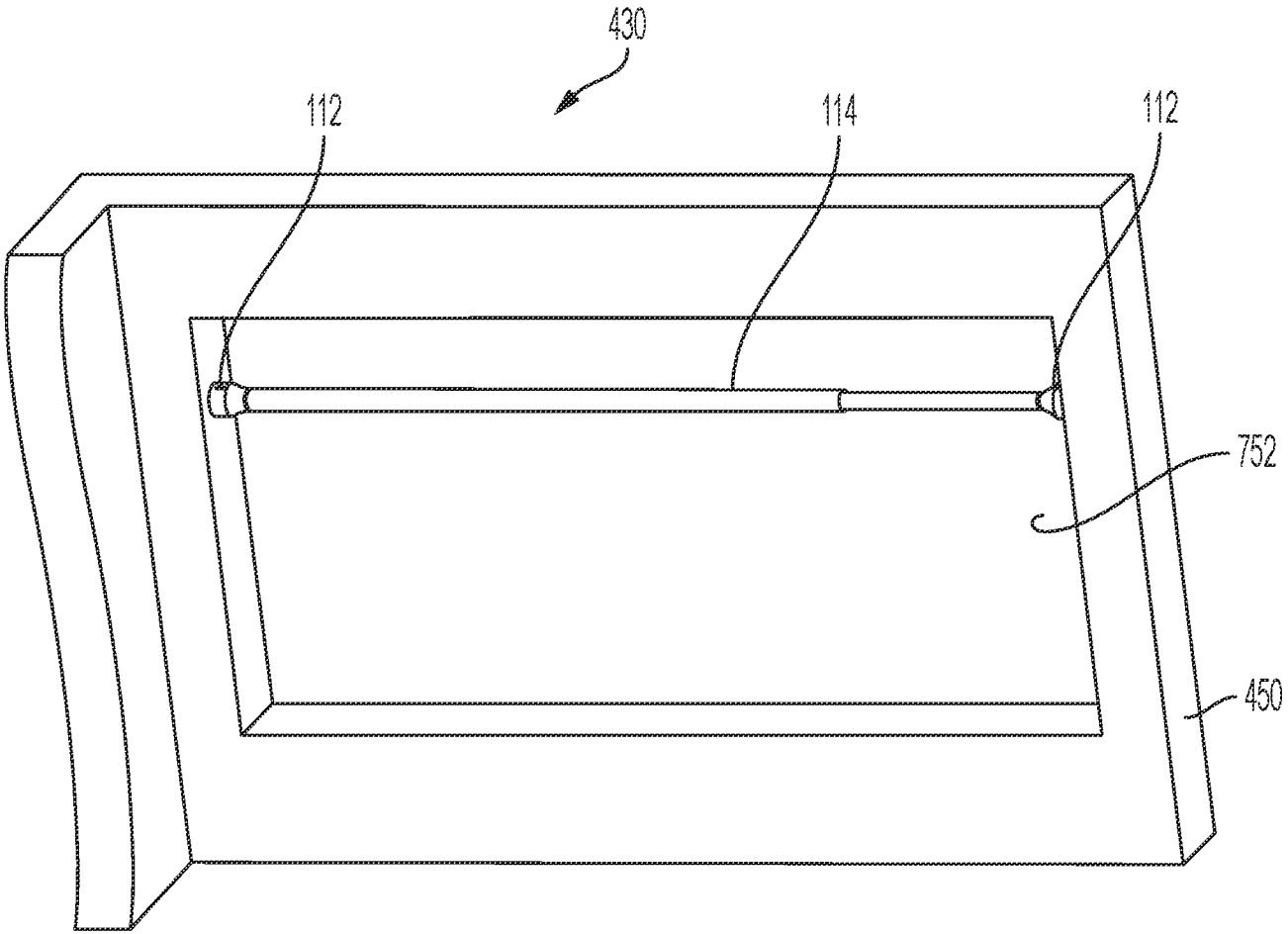
FIG. 7 is a front view of a decorative assembly according to another embodiment of the present invention that may be utilized inside a window.

FIG. 7 is a front view of a decorative assembly according to another embodiment of the present invention that may be utilized inside a window. As shown in FIG. 7, when the decorative assembly 430, such as that disclosed with regard to FIG. 1, is installed inside a window 752 that has sufficient wall space for a finial element 112 at each end of the decorative assembly 430, the decorative assembly 430 includes a telescoping rod 114, such as that disclosed with regard to FIG. 1, having a finial element 112, such as that disclosed with regard to FIG. 1, at each end. Each finial element 112 is attached to a corresponding wall inside the window 752 via either a fastening element 200 (see FIG. 2).

Figure 8:
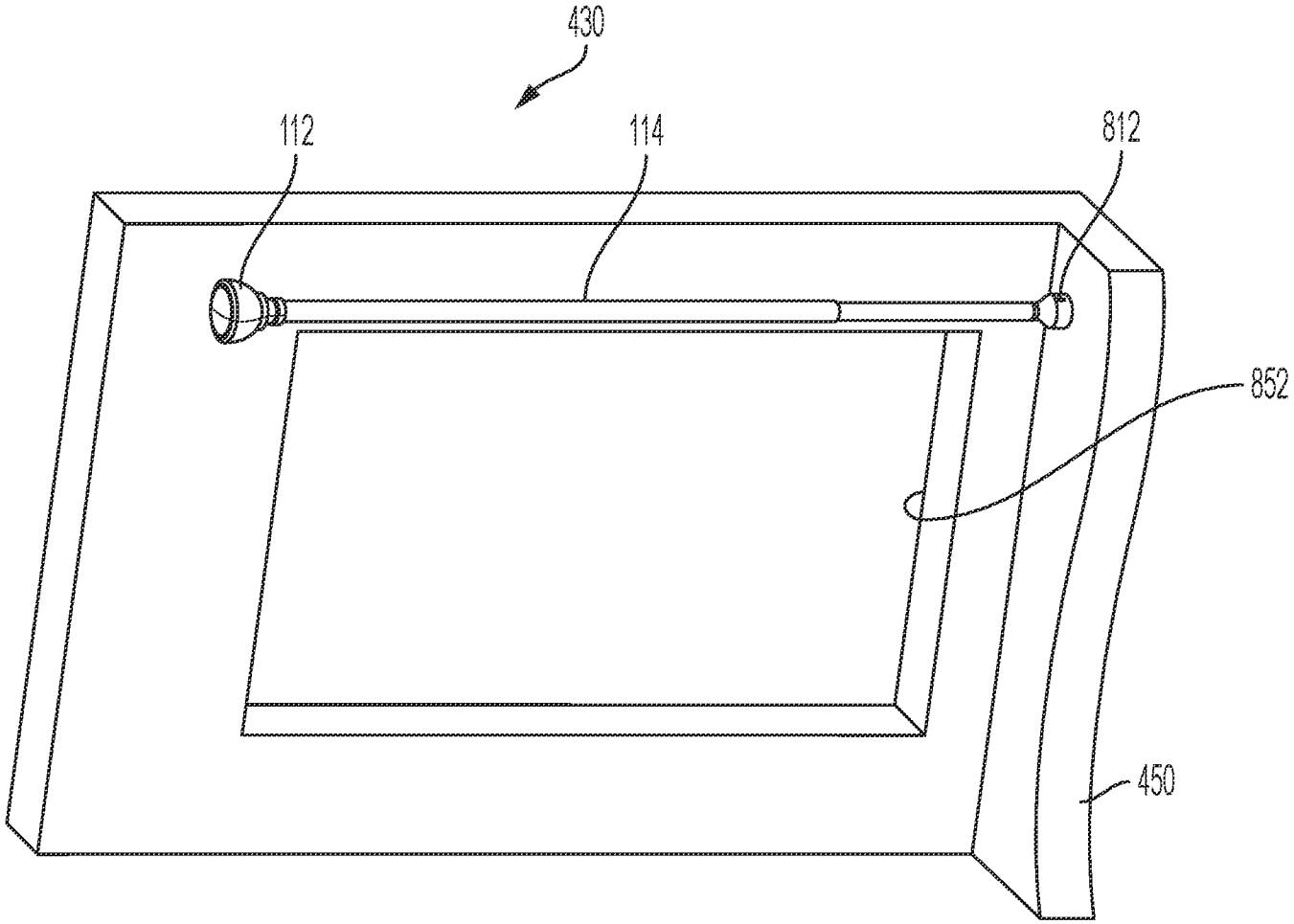
FIG. 8 is front view of a decorative assembly according to another embodiment of the present invention that may be utilized above a window in close proximity to a perpendicular wall.
Figure 9A:
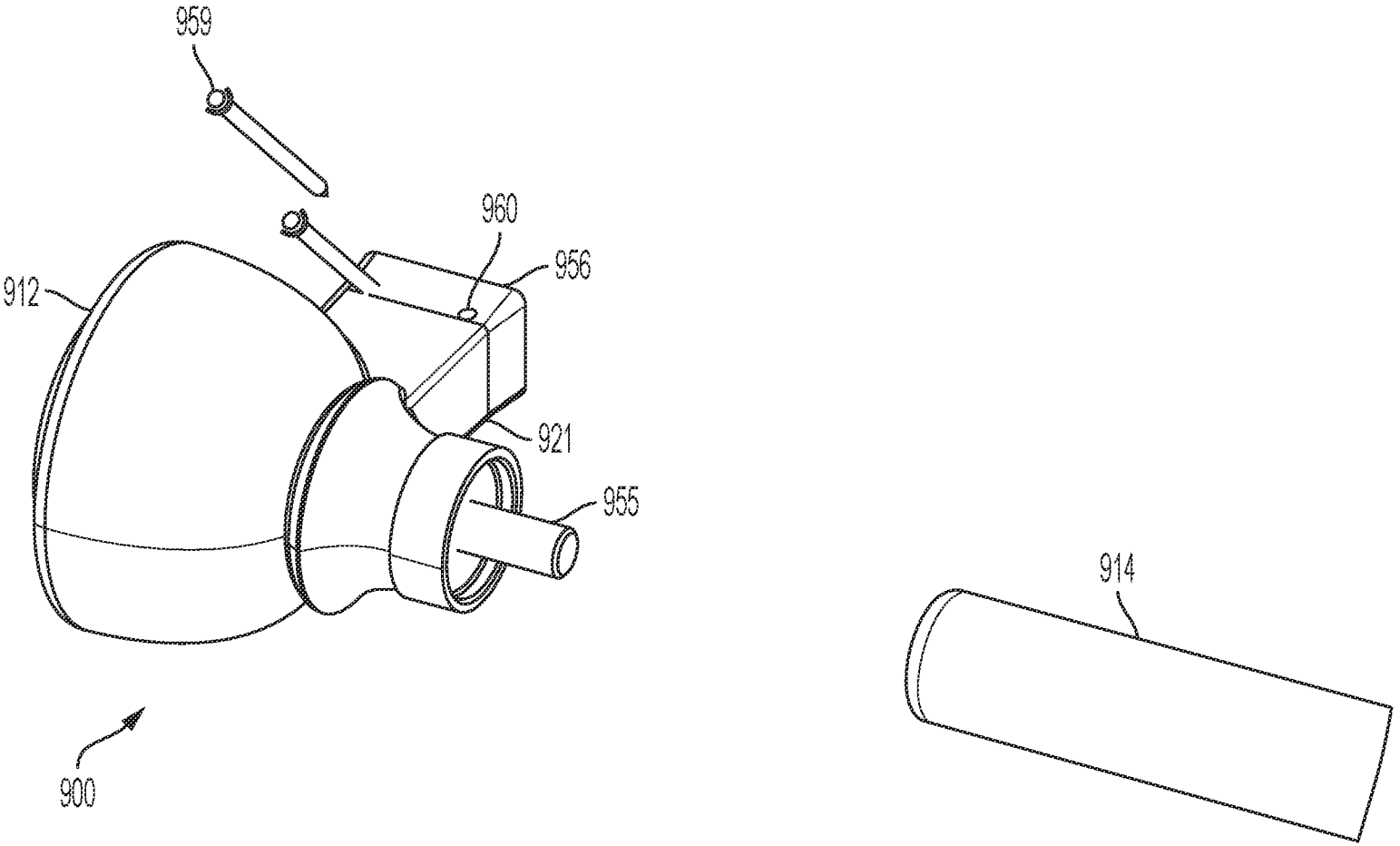
FIG. 9(*a*) is a perspective detached view of a finial assembly that has a one-piece finial and mounting bracket according to another embodiment of the present invention.
Figure 9B:
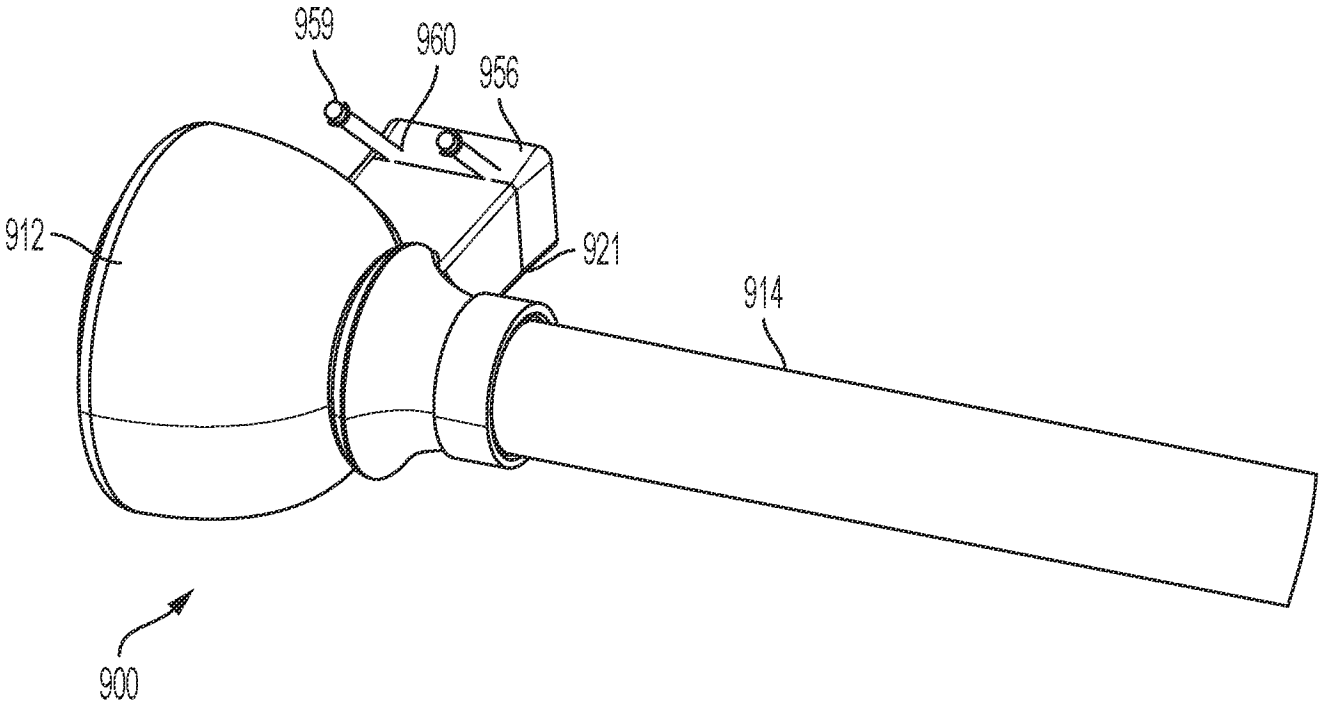
Figure 9C:
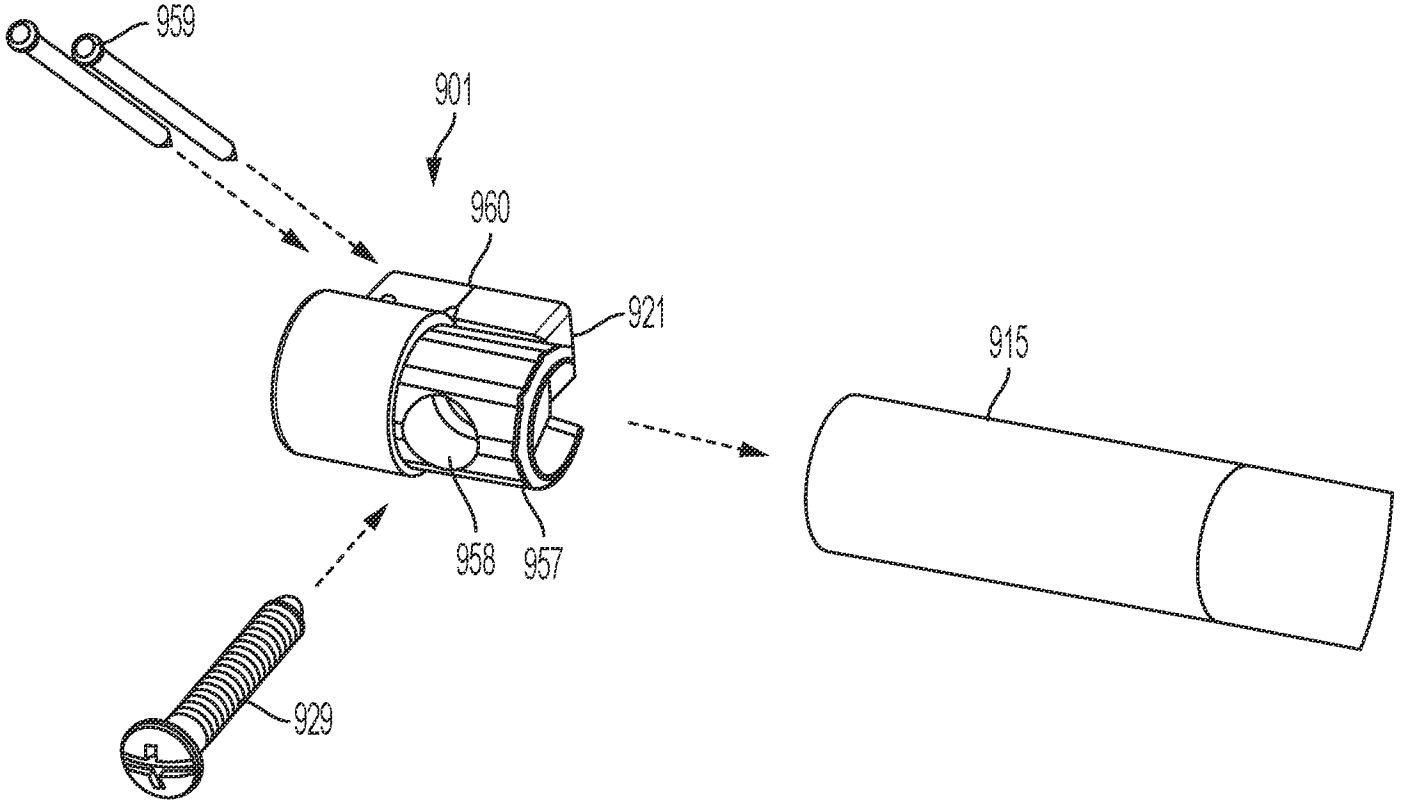
Figure 9D:
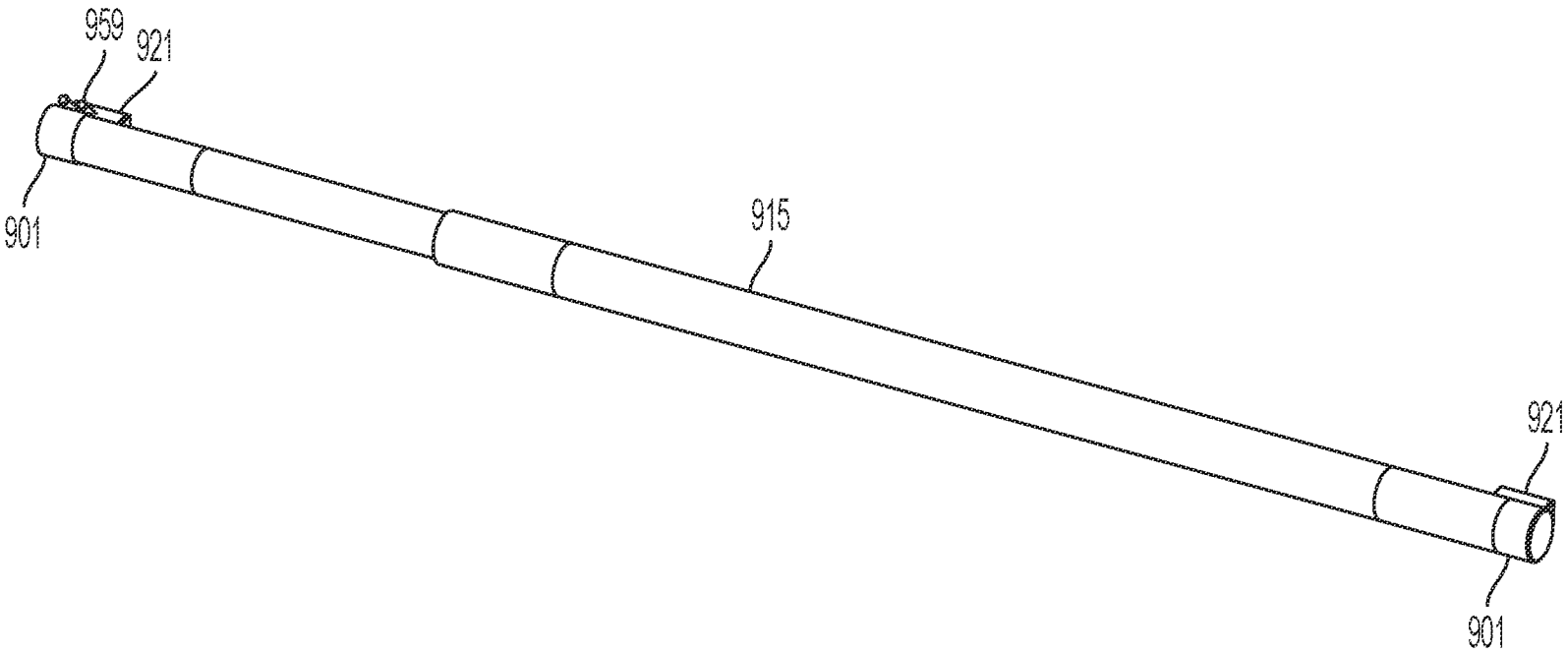

FIG. 8 is front view of a decorative assembly according to another embodiment of the present invention that may be utilized above a window in close proximity to a perpendicular wall. As shown in FIG. 8, when the decorative assembly 430, such as that disclosed with regard to FIG. 1, is installed in above window 852 that has insufficient wall space for a finial element 112 at each end of the decorative assembly 430, the decorative assembly 430 includes a telescoping rod 114, such as that disclosed with regard to FIG. 1, having a finial element 112, such as that disclosed with regard to FIG. 1, at one end and a non-finial connecting element 812 at the other end. The finial element 112 is attached to a corresponding wall above the window 852 via a fastening element 200 (see FIG. 2). The non-finial connecting element 812 is attached to a corresponding wall at the end of the window 812 via either a fastening element 200 (see FIG. 2) or the telescoping function of the rod 114 enhanced by an internal spring device or other device (not shown) to hold the corresponding rod 114 against the corresponding wall 450.

FIG. 9(*a*) is a perspective detached view of a finial assembly that has a one-piece finial and mounting bracket according to another embodiment of the present invention. FIG. 9(*b*) is an assembled view of the finial assembly in FIG. 9(*a*). FIG. 9(*c*) is a perspective detached view of another embodiment of the finial assembly in FIG. 9(*a*). FIG. 9(*d*) is an assembled view of the finial assembly in FIG. 9(*c*).

As shown in FIGS. 9(*a*) and 9(*b*), the finial assembly 900 includes a finial element 912 and a mounting bracket 921. The mounting bracket 921 includes an extended end portion 956, similar to that disclosed with regard to FIGS. 5(*a*), 5(*b*)

and 5(*c*), and is attached to the finial element 912 such that a one-piece a one-piece finial and mounting bracket is formed.

The finial element 912 includes an insertion portion 955, similar to that disclosed with regard to FIGS. 5(*a*) and 5(*b*). The extended end portion 956 of the mounting bracket 921 includes at least two nail holes 960.

As shown in FIGS. 9(*a*) and 9(*b*), the finial assembly 900 is utilized to attach the finial element 912, which is attached to at least one rod 914, similar to that disclosed with regard to FIG. 1, to a wall 450 (see FIGS. 4(*a*) and 4(*b*)) via the insertion portion 955. The extended end portion 956 is attached to a wall 450 (see FIGS. 4(*a*) and 4(*b*)) by insertion of nails 959 into the at least two nail holes 960.

The one-piece finial and mounting bracket design of the finial assembly 900 provides for fast and easy detachable-mounting to the wall 450. The detachable-mounting may be facilitated by a screw-in or plug-in process between the finial assembly 900 and the at least one rod 914 via a telescoping function of the at least one rod 914.

As shown in FIGS. 9(*c*) and 9(*d*), the finial assembly 901 utilizes hidden screw-in and/or fast-fit nails. The finial assembly 901 is similar to that disclosed with regard to FIGS. 9(*a*) and 9(*b*) with a mounting bracket 921. The mounting bracket 921 includes a screw hole 958 and an extended end portion 957.

The finial element 912 is attached to a rod 915, such as that disclosed with regard to FIG. 1, by inserting the extended end portion 957 into the rod 915. The finial assembly 901 is utilized to attach the finial element 912, which is attached to a rod 915, to a wall 450 (see FIGS. 4(*a*) and 4(*b*)). The mounting bracket 921 is attached to the wall 450 by insertion a screw 929 into the screw hole 958 or, alternately, by insertion of nails 959 into the at least two nail holes 960. The one-piece finial and mounting bracket design of the finial assembly 901 provides for fast and easy detachable-mounting to the wall 450.

While example embodiments according to the present invention have been particularly shown and described, it will be understood by those skilled in the art that various changes in form and details may be made therein without departing from the scope of the embodiment according to the present invention encompassed by the appended claims. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. A decorative assembly, comprising:

at least one rod on which a curtain or drapery is mounted;

at least one finial element configured to attach to at least a first end of the at least one rod;

at least one fastening element configured to attach to the finial element and to detachably attach to a surface such that the curtain or drapery hangs over at least one window and at least partially blocks at least a view into the at least one window or light through the at least one window;

wherein the at least one fastening element comprises a body having a pair of hook elements at a lower portion of the body, and an opening at an upper portion of the body, the opening configured to receive a plate having a pair of nails extending therefrom such that the at least one fastening element is configured to attach to a wall;

wherein the at least one fastening element is further configured to fasten to the wall with the pair of hook elements extending upwardly and outwardly:

wherein the at least one finial element comprises a recess and a plate and is configured to attach to the at least one fastening element via the pair of hook elements engaging the plate and being received within the recess such that the at least one finial element is mounted on and removed from the at least one fastening element:

wherein the at least one finial element and at least one fastening element form the decorative assembly:

the at least one rod comprises at least two rods on each of which a curtain or drapery is mounted;

the at least one finial element comprises a first finial element configured to attach to a first end of a first of the at least two rods;

a second finial element configured to attach to a first end of a second of the at least two rods;

a corner wall bracket configured to attach to a second end of the first of the at least two rods and to a second end of the second of the at least two rods such that the first of the at least two rods and the second of at least two rods are attached to each other, the corner wall bracket configured to attach to a wall between two perpendicular windows;

the at least one fastening element comprises a first fastening element configured to attach the first of the at least two rods to a first wall other than the wall between the two perpendicular windows such that the first of the at least two rods is detachably attached to the first wall; and a second fastening element configured to attach the second of the at least two rods to a second wall other than the wall between the two perpendicular windows such that the second of the at least two rods is detachably attached to the second wall;

a third fastening element configured to couple with the first finial element, the third fastening element configured to detachably mount to a first surface such that the first of the at least two rods hangs over at least a first of the two perpendicular windows and at least partially blocks at least a view into the at least the first of the two perpendicular windows or light through the at least the first of the two perpendicular windows; and a fourth fastening element configured to couple with the second finial element, the fourth fastening element configured to detachably mount to a second surface such that the second of the at least two rods hangs over at least a second of the two perpendicular windows and at least partially blocks at least a view into the at least the second of the two perpendicular windows or light through the at least the second of the two perpendicular windows.

2. The decorative assembly of claim 1, wherein:

the corner wall bracket is utilized to attach the decorative assembly to the wall between the two perpendicular windows and comprises two end brackets and a corner fastening element;

each of the two end brackets comprises an extended end portion configured to attach to the corner fastening element;

each of the two end brackets further comprises an extending portion configured to attach to one of the at least two rods;

the corner fastening element comprises two insertion portions, each configured to attach to the extended end portion of one of the two end brackets; and each of the two end brackets is attached to the fastening element by inserting the corresponding extended end portion into one of the two insertion portions of the corner fastening element.

3. The decorative assembly of claim 1, wherein:

the wall corner bracket is utilized to attach the decorative assembly to the wall between the two perpendicular windows and comprises two end brackets and two fastening elements;

each of the two fastening elements comprises an extended end portion configured to attach to one of the two end brackets;

each of the two end brackets is configured to attach to one of the two fastening elements;

each of the two end brackets comprises an extending portion configured to attach to one of the at least two rods;

each of the two fastening elements comprises an insertion portion configured to attach to the extended end portion of one of the two fastening elements;

each of the two end brackets is attached to the corresponding fastening element by inserting the corresponding extended end portion into the insertion portion of the corresponding fastening element.

* * * * *